US007691015B2

(12) United States Patent
Nye et al.

(10) Patent No.: US 7,691,015 B2
(45) Date of Patent: Apr. 6, 2010

(54) BASKETBALL GOAL SYSTEM

(75) Inventors: S. Curtis Nye, Clinton, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 590 days.

(21) Appl. No.: 11/453,327

(22) Filed: Jun. 14, 2006

(65) Prior Publication Data

US 2006/0293125 A1 Dec. 28, 2006

Related U.S. Application Data

(60) Provisional application No. 60/690,702, filed on Jun. 15, 2005, provisional application No. 60/756,640, filed on Jan. 6, 2006.

(51) Int. Cl.
*A63B 63/08* (2006.01)

(52) U.S. Cl. ..... 473/483; 473/479

(58) Field of Classification Search ..... 473/481, 473/479–483, 480, 484
See application file for complete search history.

(56) References Cited

U.S. PATENT DOCUMENTS

| | | | | |
|---|---|---|---|---|
| 4,781,375 | A | | 11/1988 | Nye |
| 4,805,904 | A | | 2/1989 | Nye |
| 4,846,469 | A | | 7/1989 | Nye |
| 4,881,734 | A | | 11/1989 | Nye |
| 5,133,546 | A | | 7/1992 | Matherne et al. |
| 5,248,140 | A | * | 9/1993 | Mower et al. ..... 473/484 |
| 5,259,612 | A | | 11/1993 | Matherne et al. |
| 5,324,027 | A | | 6/1994 | Nye |
| D351,879 | S | | 10/1994 | Matherne et al. |
| D351,881 | S | | 10/1994 | Taylor et al. |
| D351,882 | S | | 10/1994 | Taylor et al. |
| 5,354,049 | A | | 10/1994 | Matherne et al. |
| 5,375,835 | A | | 12/1994 | van Nimwegen et al. |
| 5,377,976 | A | * | 1/1995 | Matherne et al. ..... 473/483 |
| 5,484,127 | A | | 1/1996 | Mower et al. |
| 5,556,088 | A | | 9/1996 | Mower et al. |

(Continued)

OTHER PUBLICATIONS

U.S. Appl. No. 11/734,227, filed Apr. 11, 2007, Nye et al.

(Continued)

*Primary Examiner*—Gene Kim
*Assistant Examiner*—M Chambers
(74) *Attorney, Agent, or Firm*—Workman Nydegger

(57) ABSTRACT

A basketball goal system may include a basketball goal, which may include a rim assembly and a backboard, and a support structure that is sized and configured to support the basketball goal above a playing surface. The backboard may include one or more openings through which one or more portions of the rim assembly may extend, which may permit the rim assembly to be connected to the support structure. The basketball goal system may also include a base that is sized and configured to support the support structure and the rim assembly in a playing position. The base and the backboard may include openings to permit the base and the backboard to be connected when the basketball goal system is in a collapsed or storage position. In addition, the base and the backboard may include receiving portions that are sized and configured to receive and/or retain at least a portion of one or more components of the basketball goal system when the system is in the collapsed position.

27 Claims, 9 Drawing Sheets

U.S. PATENT DOCUMENTS

| | | | | |
|---|---|---|---|---|
| 5,570,880 | A | | 11/1996 | Nordgran |
| 5,573,237 | A | | 11/1996 | van Nimwegen et al. |
| 5,607,149 | A | | 3/1997 | vanNimwegen et al. |
| 5,816,955 | A | | 10/1998 | Nordgran et al. |
| 5,836,838 | A | * | 11/1998 | van Nimwegen et al. .... 473/481 |
| 5,879,247 | A | | 3/1999 | Winter et al. |
| 5,893,809 | A | * | 4/1999 | Coats et al. ..... 473/479 |
| 5,947,847 | A | | 9/1999 | van Nimwegen et al. |
| 6,027,418 | A | | 2/2000 | van Nimwegen et al. |
| 6,077,177 | A | | 6/2000 | Winter et al. |
| 6,120,396 | A | | 9/2000 | vanNimwegen et al. |
| 6,135,901 | A | | 10/2000 | vanNimwegen |
| 6,142,891 | A | | 11/2000 | Winter et al. |
| 6,155,938 | A | | 12/2000 | Mower |
| 6,273,834 | B1 | | 8/2001 | Winter |
| 6,402,644 | B2 | | 6/2002 | Stanford et al. |
| 6,419,597 | B1 | | 7/2002 | vanNimwegen et al. |
| 6,419,598 | B1 | | 7/2002 | Winter et al. |
| 6,422,957 | B1 | | 7/2002 | Winter et al. |
| 6,432,003 | B1 | | 8/2002 | van Nimwegen |
| 6,488,599 | B2 | | 12/2002 | Nye |
| 6,645,095 | B1 | | 11/2003 | Nye et al. |
| 6,656,065 | B2 | | 12/2003 | Nye |
| 6,699,146 | B1 | | 3/2004 | Winter et al. |
| 6,776,734 | B2 | | 8/2004 | vanNimwegen |
| 6,866,596 | B2 | | 3/2005 | Steed et al. |
| 6,881,162 | B2 | | 4/2005 | Nye et al. |
| 6,916,257 | B1 | | 7/2005 | van Nimwegen |
| 6,932,725 | B2 | | 8/2005 | Monsen |
| 7,044,867 | B2 | | 5/2006 | van Nimwegen |
| 7,097,574 | B2 | | 8/2006 | Nye et al. |
| 7,118,500 | B2 | | 10/2006 | Nye et al. |

OTHER PUBLICATIONS

U.S. Appl. No. 11/682,842, filed Mar. 6, 2006, Nye et al.
U.S. Appl. No. 11/500,791, filed Aug. 7, 2006, Nye et al.
U.S. Appl. No. 11/494,411, filed Jul. 26, 2006, Nye et al.
U.S. Appl. No. 11/682,247, filed Mar. 5, 2007, Nye et al.
U.S. Appl. No. 11/333,914, filed Jan. 17, 2006, Stanford et al.
U.S. Appl. No. 11/333,912, filed Jan. 17, 2006, Nye et al.
U.S. Appl. No. 11/331,496, filed Jan. 12, 2006, Nye et al.
U.S. Appl. No. 11/433,995, filed May 15, 2006, van Nimwegen.

* cited by examiner

BASKETBALL GOAL SYSTEM

CROSS-REFERENCE TO RELATED APPLICATIONS

This application claims priority and the benefit of U.S. provisional patent application Ser. No. 60/690,702, filed Jun. 15, 2005 and entitled BASKETBALL GOAL SYSTEM, and U.S. provisional patent application Ser. No. 60/756,640, filed Jan. 6, 2006 and entitled BASKETBALL GOAL SYSTEM. The disclosures of each are incorporated by reference in their entirety.

BACKGROUND OF THE INVENTION

1. Field of the Invention

The present invention generally relates to basketball and, in particular, to a basketball goal system.

2. Description of Related Art

Basketball is a very popular game and the game of basketball typically includes players, a basketball and a basketball goal system. Conventional basketball goal systems may be permanently fixed in a particular location or movable from one location to another location. Conventional basketball goal systems typically include a basketball goal, which may include a rim, a backboard, and/or a net; and basketball goal systems typically include a support structure, such as a support pole, that supports a basketball goal at a desired height.

Unfortunately, some known support structures for conventional basketball goal systems can be large and/or heavy, which can make shipping the system more expensive. Also, such large and heavy support structures can make assembling the basketball goal system more difficult. Further, many conventional basketball goal systems often include several large and/or awkwardly sized components, making them inefficient for storage and/or shipping.

BRIEF SUMMARY OF EMBODIMENTS OF THE INVENTION

A need therefore exists for a basketball goal system that eliminates or diminishes the above-described disadvantages and problems.

One aspect is a basketball goal system that may be selectively moved from one location to another location. Desirably, the basketball goal system is a portable basketball goal system that is readily capable of being moved. Advantageously, the portable basketball goal system may be quickly and easily moved from one location to another and the basketball goal system may be moved by one or more persons. The basketball goal system may also be permanently fixed at a particular location, if desired.

Another aspect is a basketball goal system that may include a base, a support structure and a basketball goal. The basketball goal may include a backboard, a rim or a hoop and/or a net; and the support structure may include one or more support members. The basketball rim may have a displaceable (or break away) configuration or a fixed configuration, and the basketball backboard may have a variety of suitable configurations and arrangements. The support structure may be connected to the basketball goal and may help support the basketball goal at a desired height about a playing surface. The support structure may have various configurations depending, for example, upon the type of basketball system and the support structure may allow the height of the basketball goal to be varied. The support structure may also be movable between a plurality of positions, such as between an extended or use position and a collapsed or storage position.

A further aspect is a basketball goal system that may include a support structure with telescoping support members. For example, the support structure may include three support members that telescope to adjust the length of the support structure. By adjusting its length, the support structure may advantageously support the basketball goal at a variety of desired heights. The support structure may, however, have a fixed length if desired. The support members may also be sized and configured to be disposed in one or more other positions. For example, the support members may include one or more apertures or other features that are sized and configured to receive a pin, fastener or locking member to help secure the support members in a desired position.

Advantageously, because the support members may allow the support structure to support the basketball goal at a variety of desired heights, persons of different heights and ages may enjoy using the basketball goal system. Further, because the support members may telescope together, the support members may be compactly collapsed to facilitate more efficient storage and/or shipping. For example, a first support member may be sized and configured to permit all or at least a portion of one or more of the other support members to nest within the first support member. With the support members in a nested configuration, the support members may occupy less space in a shipping container, which may permit more efficient packaging and decreased shipping costs. Of course, the support structure does not require telescoping or nested support members, and the support structure may have other configurations.

Yet another aspect is a basketball goal system that may be movable between a plurality of positions, such as between an extended or use position and a collapsed or storage position. For example, the basketball goal system may include a base and a support structure this is pivotally or otherwise movably connected to the base. This may allow the basketball goal system to be moved between the extended or use positions and the collapsed or storage positions. In the collapsed or storage positions, the support structure may contact, abut and/or engage at least a portion of a base; and the base may include one or more receiving portions that are sized and configured to receive and/or retain at least a portion of the support structure. The receiving portions may retain at least a portion of the support structure using a snap fit, a friction fit, an interference fit or the like, if desired. The support structure could also be retained within the receiving portions using one or more fasteners or other suitable means.

Another aspect is a basketball goal system that may include a base and the base may be sized and configured to receive ballast such as sand or water. For example, the base may include a hollow interior portion that is sized and configured to received ballast and/or a relatively large surface or portion upon which ballast may be placed. Advantageously, the base may be constructed from relatively lightweight materials, such as plastic, which may allow the basketball goal system to be easily shipped and transported. In addition, the base could be constructed from blow-molded plastic which may help create a lightweight, rigid and sturdy structure.

Still another aspect is a basketball goal system that may include a base with one or more receiving portions that are sized and configured to receive and/or retain all or at least a portion of a basketball rim. The receiving portions may, for example, retain at least a portion of the basketball rim using a snap fit, a friction fit, an interference fit or the like. The receiving portions may also permit the basketball rim to be generally disposed between upper and lower portions of the base. Additionally, the receiving portions may allow the rim to be disposed between the base and the backboard when the system is in the collapsed position. The basketball rim could also be retained within the receiving portions using one or more fasteners or other suitable means. The receiving portions may advantageously provide a compact configuration that facilitates efficient storage and/or shipping of the basketball goal system.

Yet another aspect is a basketball goal system that may include a basketball goal, a support structure that is sized and configured to support the basketball goal at a desired height, and a connecting structure that may connect the rim to the support structure. For example, the connecting structure may include a first portion, such as a upper plate, and a second portion, such as a back or a lower plate. One or more rim braces may connect the second portion of the connecting structure and the rim. The connecting structure may also include one or more flanges that may be sized and configured to be attached to the support structure. The flanges may extend through an opening or other portion of the backboard to facilitate connection of the backboard and/or the rim to the support structure. In greater detail, the flanges may be connected to generally opposing portions of the support structure, but the attachment flanges may be connected to any other suitable portions of the support structure. The connecting structure is preferably a unitary one-piece structure that is constructed of metal, but the connecting structure may be constructed from one or more components and/or of other materials.

Another aspect is a basketball goal system that may include one or more components that may be retained in a collapsed or storage position, which may facilitate storage and/or shipping of the basketball goal system. For example, the backboard may be attached to the base and at least a portion of one or more components of the basketball goal system (such as the rim, support structure, support member, etc.) may be positioned between the backboard and the base in the collapsed or storage position. Advantageously, the backboard may help retain these components in the desired positions in the collapsed or storage position. In greater detail, the base and/or the backboard may include one or more receiving portions that are sized and configured to receive and/or retain at least a portion of the one or more components. The receiving portions may retain at least a portion of the components using a snap fit, a friction fit, an interference fit and the like. The backboard may also be attached to the base using one or more fasteners and/or other suitable means. Other components of the basketball goal system may be attached to the base and/or the backboard using one or more fasteners and/or other suitable means.

Yet another aspect is a basketball goal system that may include a base, one or more braces, and a rim. The base may include a receiving portion that is sized and configured to receive and/or retain at least a portion of the rim when the basketball system is in the collapsed or storage position. The base may also include one or more receiving portions that are sized and configured to receive and/or retain at least a portion of the braces when the basketball goal system is in the collapsed or storage position. Advantageously, the braces may help retain the rim in the desired position when the basketball goal system is in the collapsed or storage position.

Still another aspect is a basketball goal system that may include a support pole that is adjustable in length. For example, the support pole may include three telescoping potions that may be collapsed into the space of a single portion. The three telescoping portions may have different diameters to allow the support pole to be collapsed, such as 2¼ inches, 2 inches and 1¾ inches. This may also allow the support pole to be adjustable in height, such as between about 6½ feet and about 3½ feet or between about 6½ feet and about 10 feet, but the support pole may have any desired height. Of course, the support pole could have other suitable shapes, sizes, configurations and arrangements.

Another aspect is a basketball goal system that may allow the rim to be attached to the support pole. For example, the rim may be directly connected to the support pole by a bracket. The bracket may include flanges that are disposed through slots or openings in the backboard. Thus, the rim can be directly attached to the support pole, but the rim could be attached to the backboard or other suitable portions of the basketball goal system.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a basketball goal system. The principles of the present invention, however, are not limited to basketball goal systems. It will be understood that, in light of the present disclosure, the basketball goal system disclosed herein can be successfully used in connection with other types of sporting equipment and systems.

Additionally, to assist in the description of the basketball goal system, words such as top, bottom, front, rear, right and left may be used to describe the accompanying figures, which are not necessarily drawn to scale. It will be appreciated, however, that the basketball goal system can be located in a variety of desired positions—including various angles, positions and configurations. A detailed description of the basketball goal system now follows.

Figure 1:
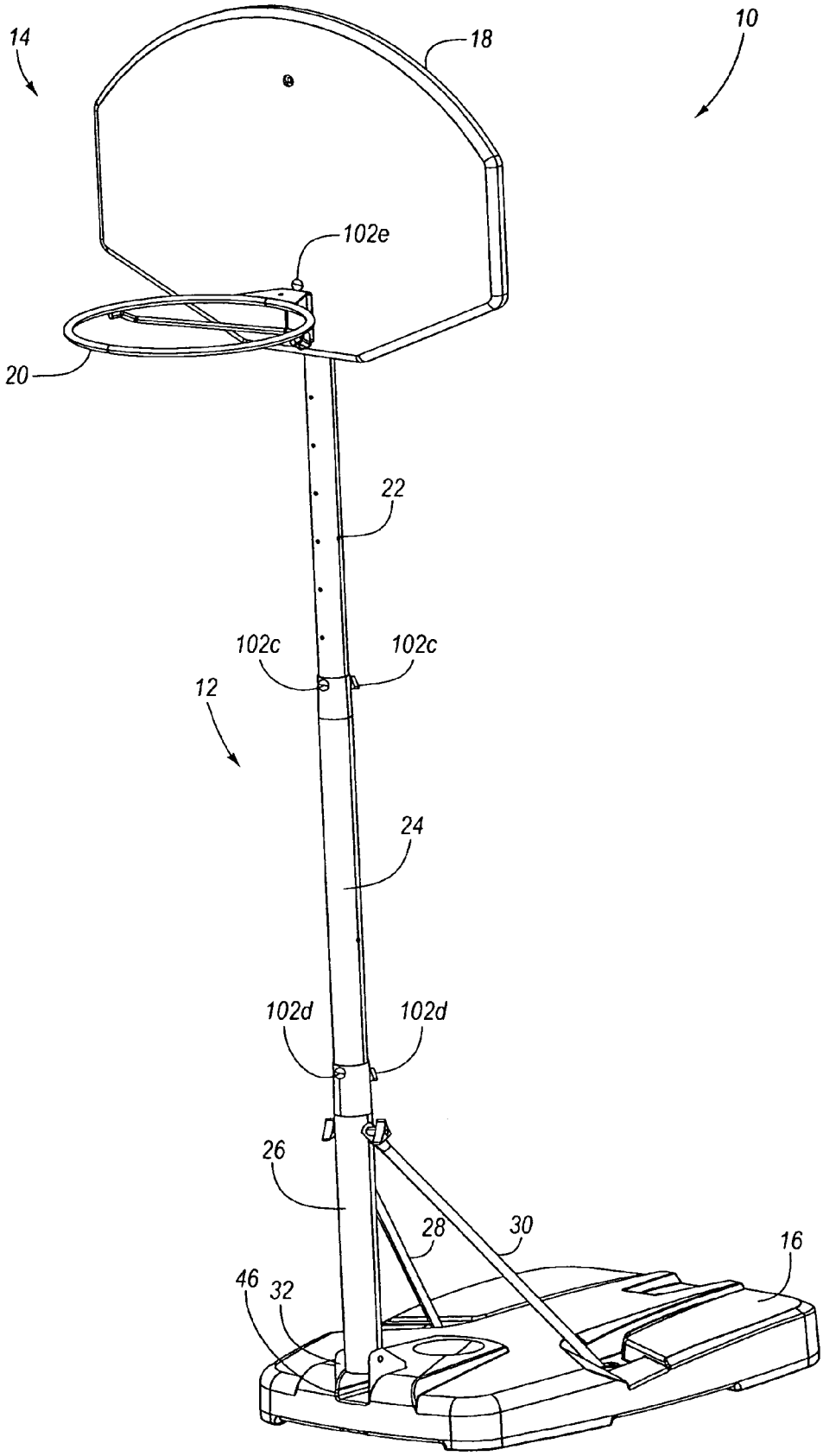
FIG. 1 is a perspective view of an exemplary basketball goal system.

The basketball goal system 10 shown in FIG. 1 is preferably a portable basketball goal system that is readily capable of being moved from one location to another location. Advantageously, the basketball goal system 10 may be quickly and easily moved from one location to another, and the basketball goal system may be moved by one or more persons. The basketball goal system 10 may also be permanently fixed at a particular location, if desired.

The basketball goal system 10 may include a support structure 12, a basketball goal 14 and a base 16. The basketball goal 14 may include a backboard 18, a rim 20 and/or a net. The basketball rim 20 may have a displaceable (or break away) configuration or a fixed configuration, and the backboard 18 may have a variety of suitable configurations and arrangements. It will be appreciated that the basketball goal system 10, including the support structure 12, the basketball goal 14 and the base 16, may have a wide variety of suitable configurations and arrangements.

The support structure 12 may help support the basketball goal 14 at a desired height above a playing surface and may allow the height of the basketball goal 14 to be varied. The support structure 12 may also be constructed from a relatively strong material, such as metal. In addition, the support structure 12 may include support members 22, 24, 26, which may allow the length of the support structure to be adjusted. By adjusting its length, the support structure 12 may advantageously support the basketball goal 14 at a variety of desired heights. For example, the support structure 12 may have an adjustable length between about 3.5 feet and about 6.5 feet, which may allow the support structure to support the basketball goal 14 at a height more comfortable for children. The support structure 12 may also have an adjustable length between about 6.5 feet and about 10 feet for use by adults. The support structure 12 may also have a shorter or longer length, and the support structure may have a fixed length, if desired.

The support members 22, 24, 26 may be sized and configured to be selectively and releasably locked in one or more relative positions. For example, the support members 22, 24, 26 may include one or more apertures or other features that are sized and configured to receive a pin, fastener or locking member to help secure the support members in one or more desired relative longitudinal and/or rotational orientations. The support members 22, 24, 26 preferably have a generally circular cross section and preferably have progressively larger sizes to permit the support members to nest and/or telescope. For example, the support members 22, 24, 26 may have diameters of approximately 1¾ inches (4.4 centimeters), 2 inches (5.1 centimeters) and 2¼ inches (5.7 centimeters), respectively. It will be appreciated, however, that the support members 22, 24, 26 could have other suitable shapes and sizes.

Advantageously, because the support members 22, 24, 26 may allow the support structure 12 to support the basketball goal 14 at a variety of desired heights, persons of different heights and ages may enjoy using the basketball goal system 10. Further, because the support members 22, 24, 26 may telescope together, the support members may be collapsed to facilitate more efficient storage and/or shipping. For example, the support member 26 may be sized and configured to permit all or at least a portion of either or both support members 22, 24 to nest within the support member 26. With the support members 22, 24, 26 in such a nested configuration, the support members may occupy less space in a shipping container, which may reduce shipping costs. Of course, the support structure 12 does not require telescoping or nested support members, and the support structure may have other configurations.

As shown in FIG. 1, the support structure 12 may be positioned in a generally fixed position using braces 28, 30, which may be connected to the base 16 and the support structure. In particular, the braces 28, 30 each preferably include a first end connected to the base 16 and a second end connected to the support structure 12. The braces 28, 30 may be connected to the support structure and/or the base 16 using a snap fit, a friction fit, an interference fit, fasteners, adhesives and/or other suitable devices or means.

Figure 2:
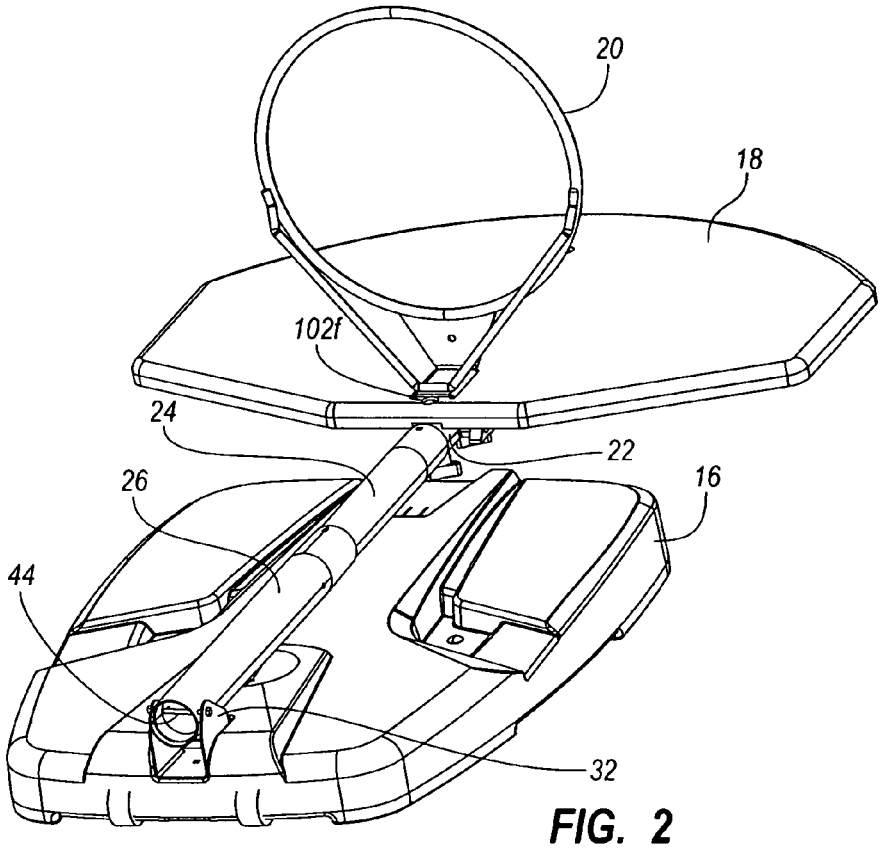
FIG. 2 is a perspective view of the basketball goal system shown in FIG. 1, illustrating the support structure in a storage position.

As shown in FIGS. 1 and 2, the support structure 14 may be movable between an extended or use position and a collapsed position or storage position. In particular, the braces 28, 30 may be disconnected from the support structure 12, which may allow the support structure to pivot or otherwise move to the collapsed or storage position shown in FIG. 2. In the collapsed or storage position, the support structure may contact, abut and/or engage at least a portion of the base 16. The base 16 may include one or more receiving portions that are sized and configured to receive and/or retain at least a portion of the support structure in the collapsed or storage position. The receiving portions may, for example, retain at least a portion of the support structure using a snap fit, a friction fit, an interference fit or the like.

Figure 3:
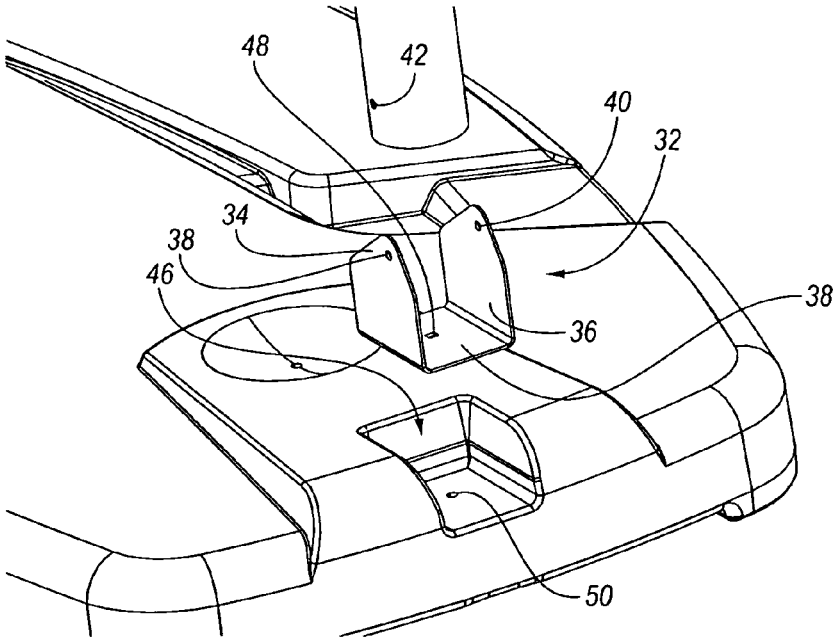
FIG. 3 is an exploded view a portion of the basketball goal system shown in FIG. 1.

As shown in FIGS. 1-3, the basketball goal system 10 may include a bracket 32 that may be used to pivotally or otherwise movably connect the support structure 12 to the base 16. For example, the bracket 32 may be connected to the base 16 and the support structure 12 may be pivotally connected to the bracket. The bracket 32 may advantageously allow the support structure 12 to more smoothly and easily move among desired positions. In addition, the bracket 32 may allow the support structure 12 to be stored generally flat against an upper portion of the base 16.

In further detail, the bracket 32 preferably has a generally U-shape that may include a first flange 34, a second flange 36 and an intermediate portion 38 extending between the flanges. The intermediate portion 38 of the bracket 32 may be connected to the base 16, and the flanges 34, 36 of the bracket may be pivotally connected to the support member 26 of the support structure 12. The flanges 34, 36 and the support structure 12 may include openings 38, 40, 42 that may receive a pivot pin or a fastener 44 to pivotally connect the flanges to the support structure. The base 16 may include receiving portions 46 that may be sized and configured to receive and/or retain at least a portion of the bracket 32. The intermediate portion 38 of the bracket 32 and the base 16 may include openings 48, 50 that may receive one or more fasteners to connect the intermediate portion to the base. It will be appreciated that the bracket 32 may have a variety of suitable shapes and configurations and the support structure 12 may be connected to the base 16 in any suitable configuration or arrangement. It will also be appreciated that the bracket 32 may be connected to the support structure 12 and/or the base 16 using a variety of suitable means.

As shown in FIGS. 4-7, the basketball goal system 10 may include a rim assembly 52 that includes the rim 20. The rim assembly 52 may also include rim braces 54, 56, which may be sized and configured to increase the strength and/or stability of the rim 20. Additionally, the rim assembly 54 may include a connecting member 58 that is sized and configured to mount the rim 20 to the backboard 18 and/or the support structure 12. The braces 54, 56 are preferably connected to the rim 20 and/or the connecting member 58 using fasteners, welding or the like.

Figure 7:
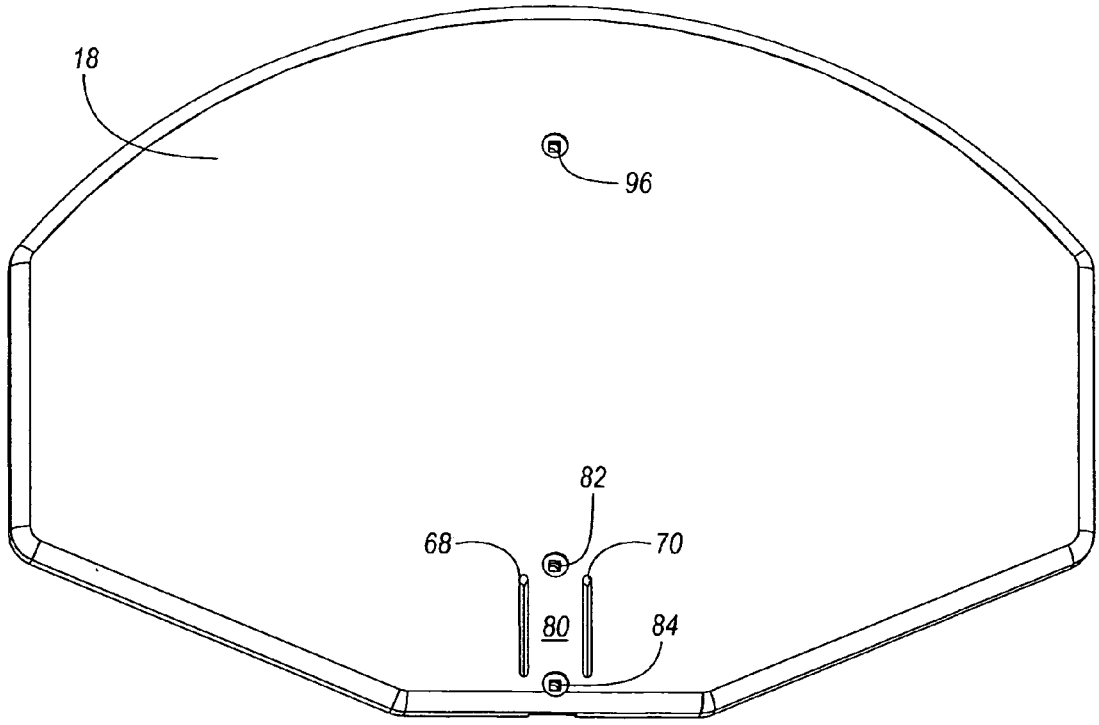
FIG. 7 is a front view of a portion of the basketball goal system shown in FIG. 1.

In greater detail, the connecting member 58 may include left side flange 60, a right side flange 62, an upper plate 64 and a back plate 66. The flanges 60, 62 of the connecting member 58 are preferably sized and configured to be connected to the support structure 12. In particular, as shown in FIG. 7, the backboard 16 may include receiving portions 68, 70, such as openings, slots, indentations and the like, that are sized and configured to receive the flanges 60, 62 of the connecting member 58. The receiving portions 68, 70 are preferably spaced apart from the outer perimeter of the backboard 18, but the receiving portions 68, 70 may be disposed in any suitable portion of the backboard.

Figure 4:
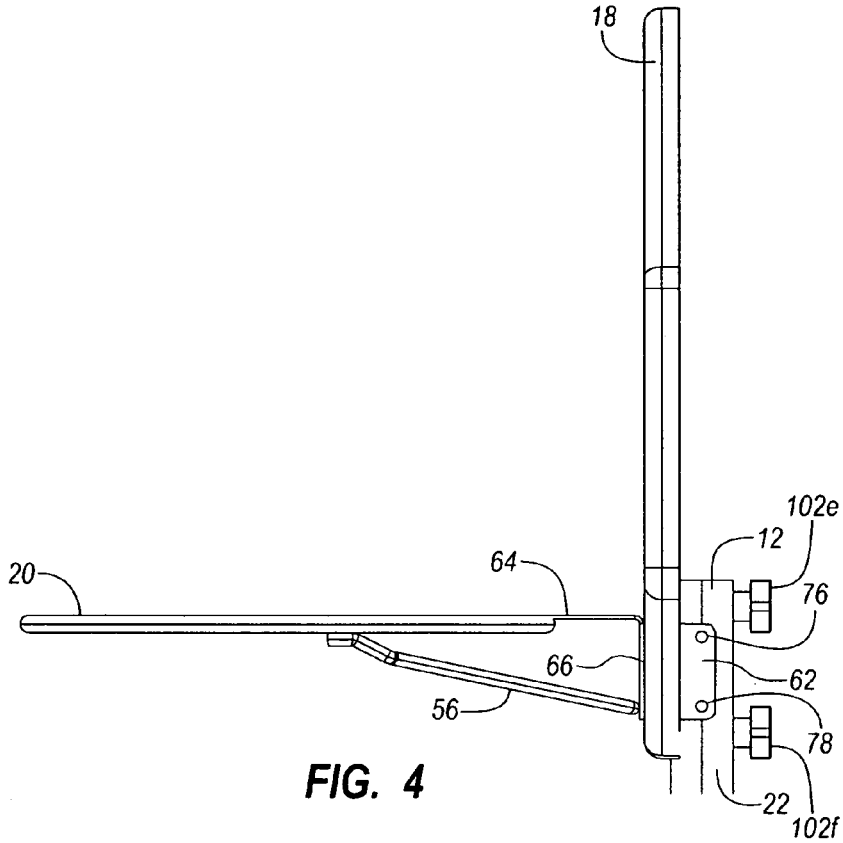
FIG. 4 is a right side view of a portion of the basketball goal system shown in FIG. 1.
Figure 5:
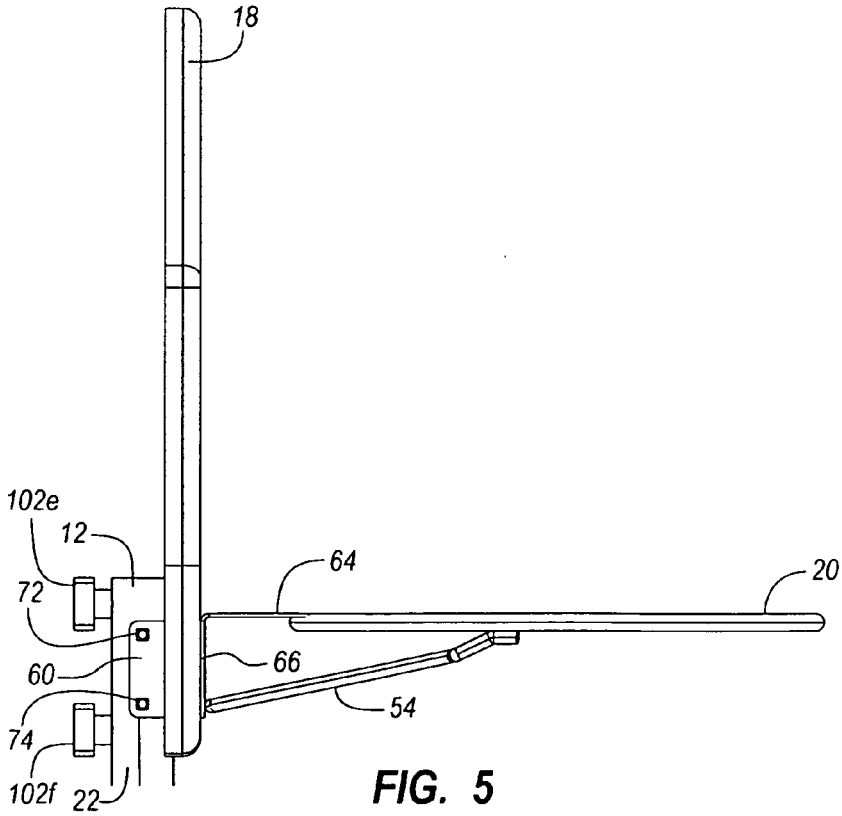
FIG. 5 is a left side view of a portion of the basketball goal system shown in FIG. 1.
Figure 6:
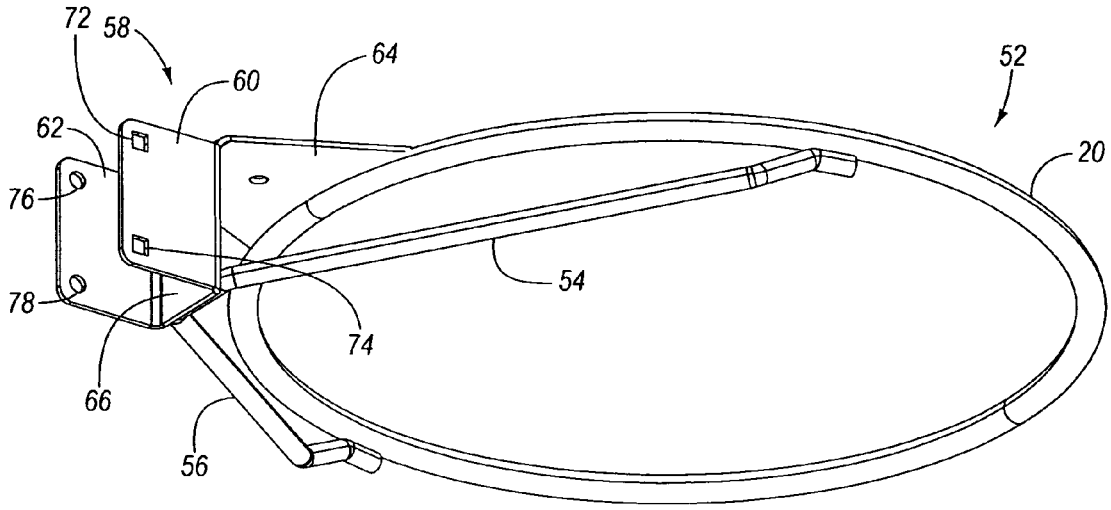
FIG. 6 is a perspective view of a portion of the basketball goal system shown in FIG. 1.

At least a portion of the flanges 60, 62 may be inserted through the receiving portions 68, 70, as shown in FIGS. 4 and 5. The flanges 60, 62 and the support member 22 of the support structure 12 may include openings 72, 74, 76, 78 that are sized and configured to receive one or more fasteners to connect the flanges to the support member. When the flanges 60, 62 are connected to the support structure 12, the plate 66 may contact, abut and/or engage a portion of the backboard 18 (such as a portion 80 of a front surface of the backboard), which may help connect the backboard to the support member 22. In addition, to connect the backboard 18 to the support structure 12, the backboard and the support member 22 of the support structure may include openings 82, 84 that are sized and configured to receive one or more fasteners. It will be appreciated that the flanges 60, 62, the plates 64, 66, and/or the backboard 18 may be connected to other suitable portions of the basketball goal system 10 using any other suitable means, if desired.

The flanges 60, 62 and the plates 64, 66 may advantageously be formed as part of a unitary, one-piece connecting member 58. For example, the connecting member 58 may be constructed from sheet metal that is formed into the desired configuration, but the connecting member may also be constructed from other suitable materials. It will be appreciated that the connecting member 58 may have a variety of other suitable sizes, shapes, configurations and arrangements depending, for example, upon the intended use of the basketball goal system 10.

Figure 8:
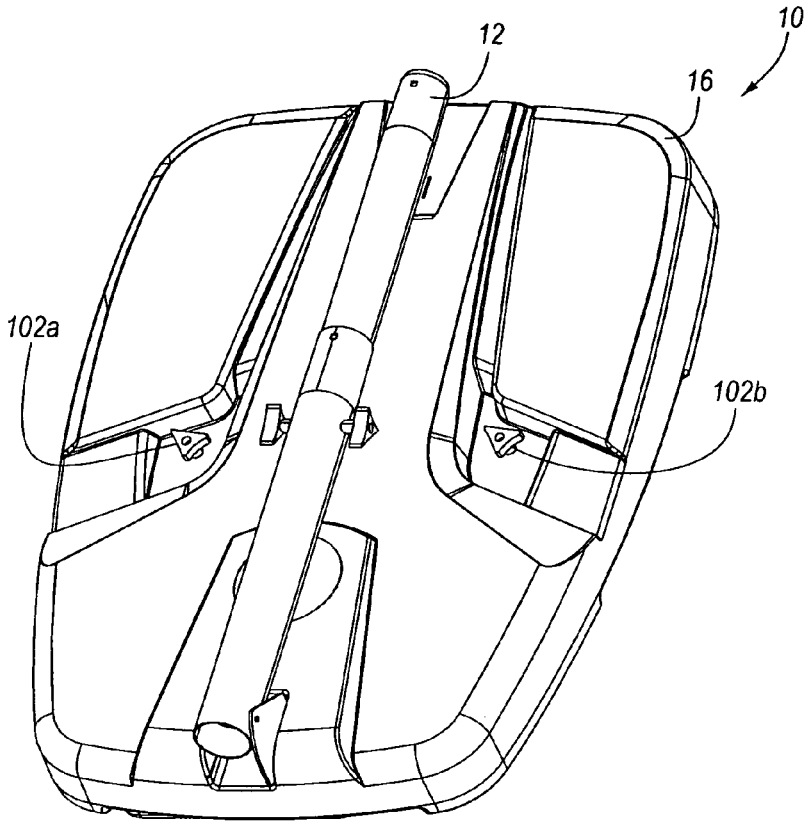
FIG. 8 is a perspective view of the basketball goal system shown in FIG. 1, illustrating an exemplary storage or shipping arrangement.
Figure 9:
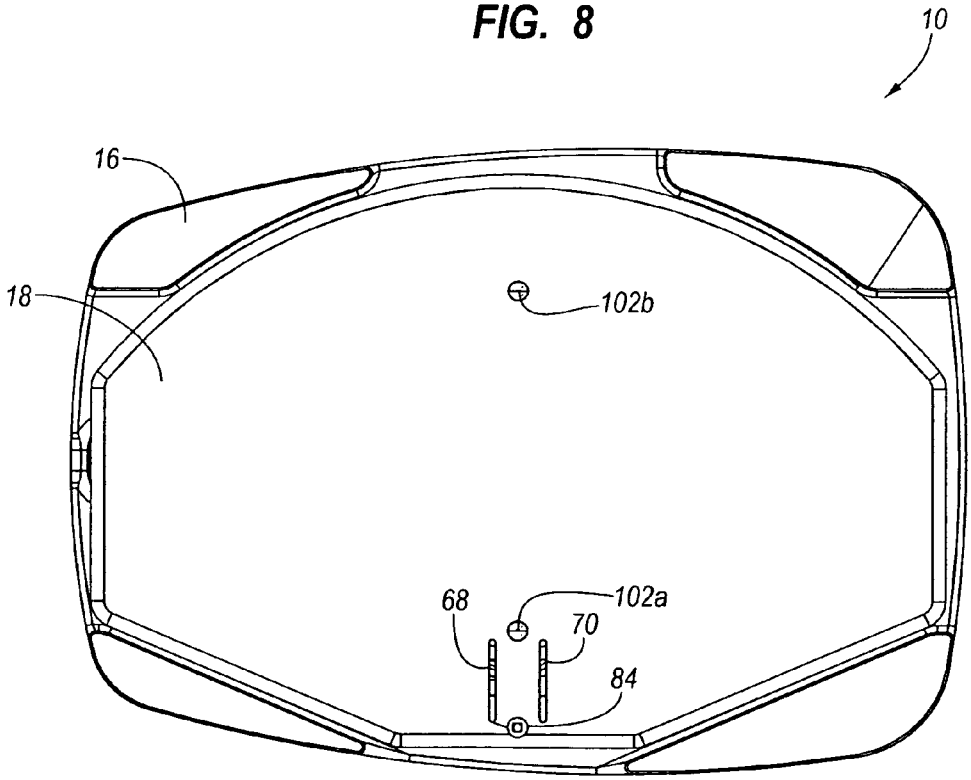
FIG. 9 is a bottom view of the basketball goal system in the storage or shipping arrangement shown in FIG. 8.
Figure 10:
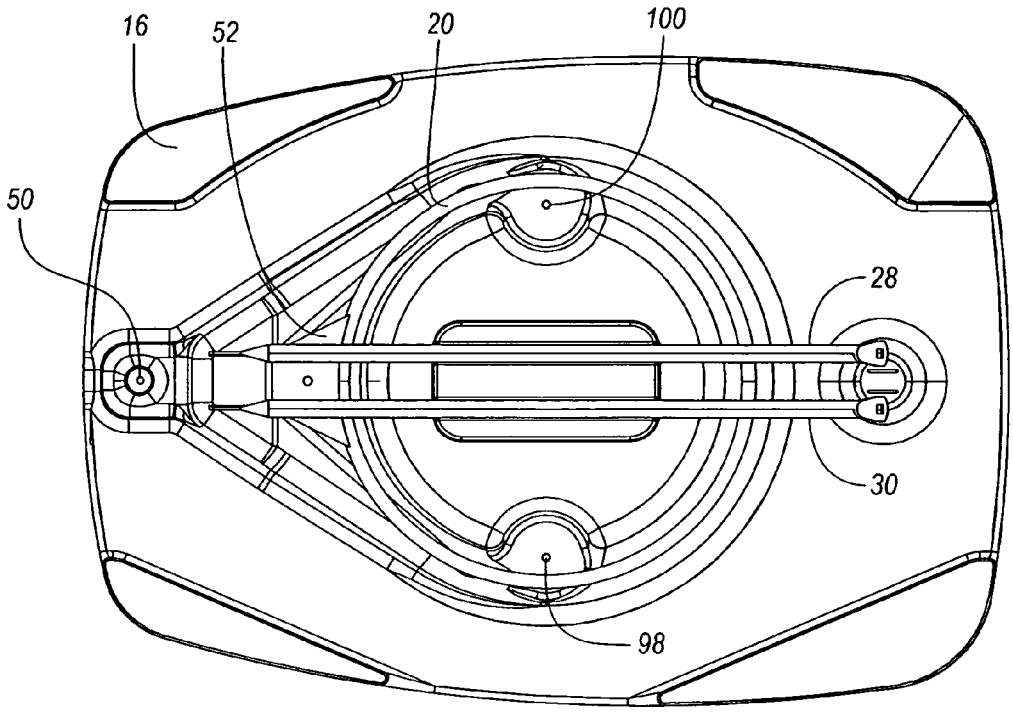
FIG. 10 is a bottom view of a portion of the basketball goal system in the storage or shipping arrangement.
Figure 11:
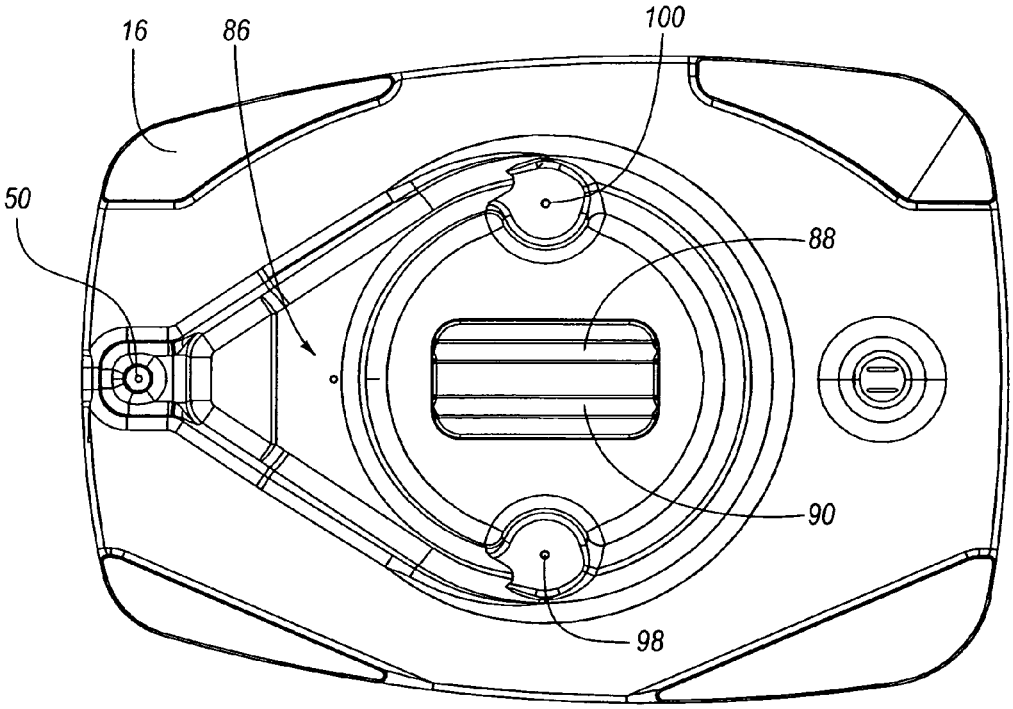
FIG. 11 is a bottom view of a portion of the basketball goal system in the storage or shipping arrangement.
Figure 12:
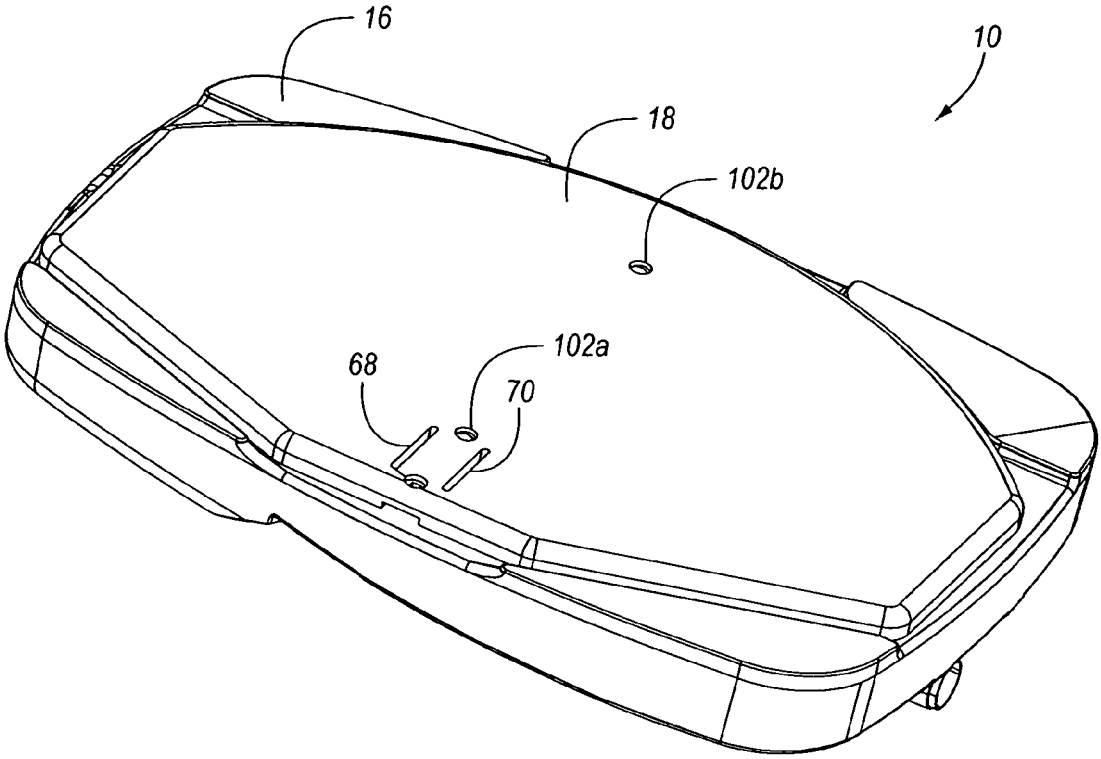
FIG. 12 is a bottom perspective view of the basketball goal system in the storage or shipping arrangement.
Figure 13:
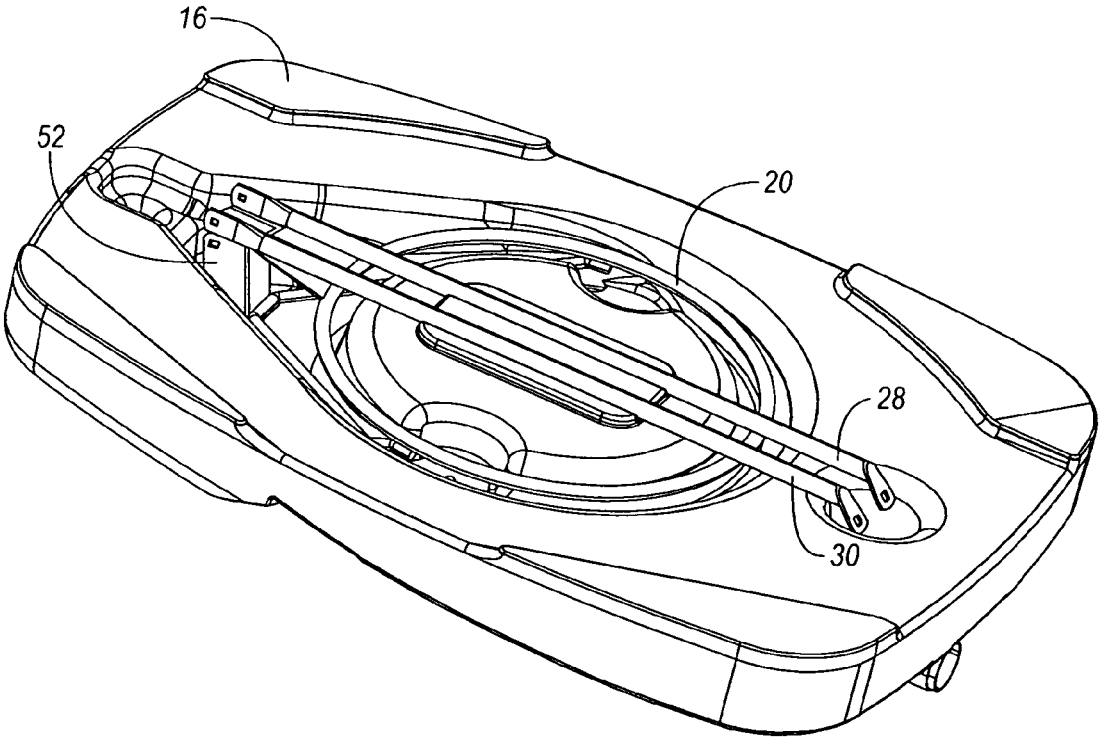
FIG. 13 is a bottom perspective view of a portion of the basketball goal system in the storage or shipping arrangement.
Figure 14:
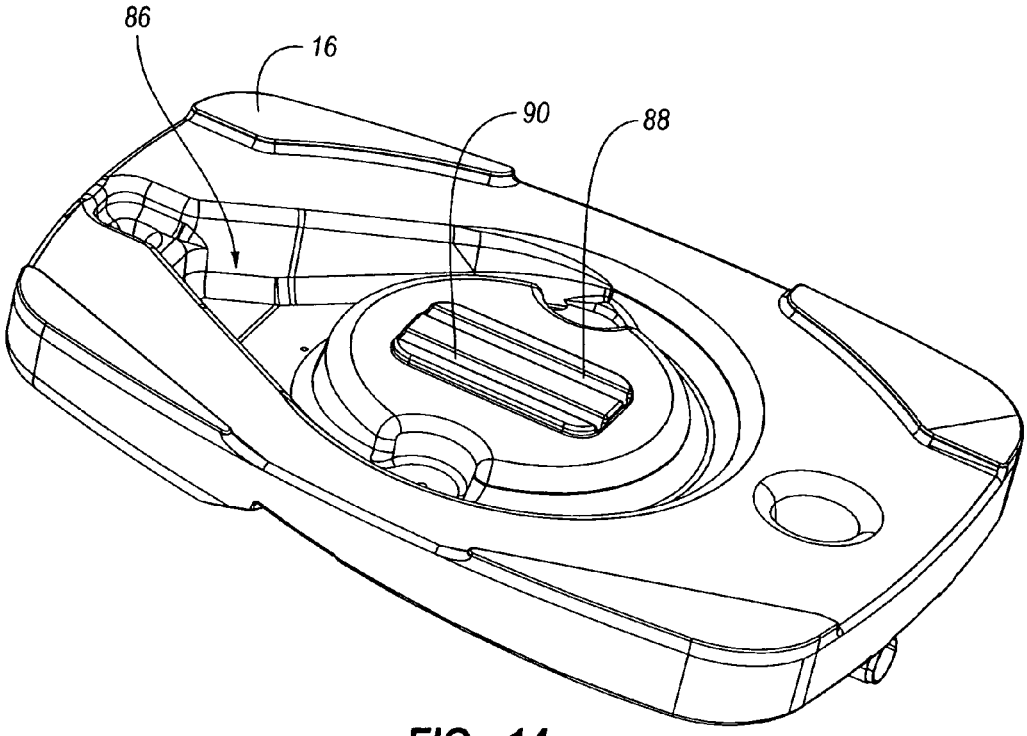
FIG. 14 is a bottom perspective view of a portion of the basketball goal system in the storage or shipping arrangement.
Figure 15:
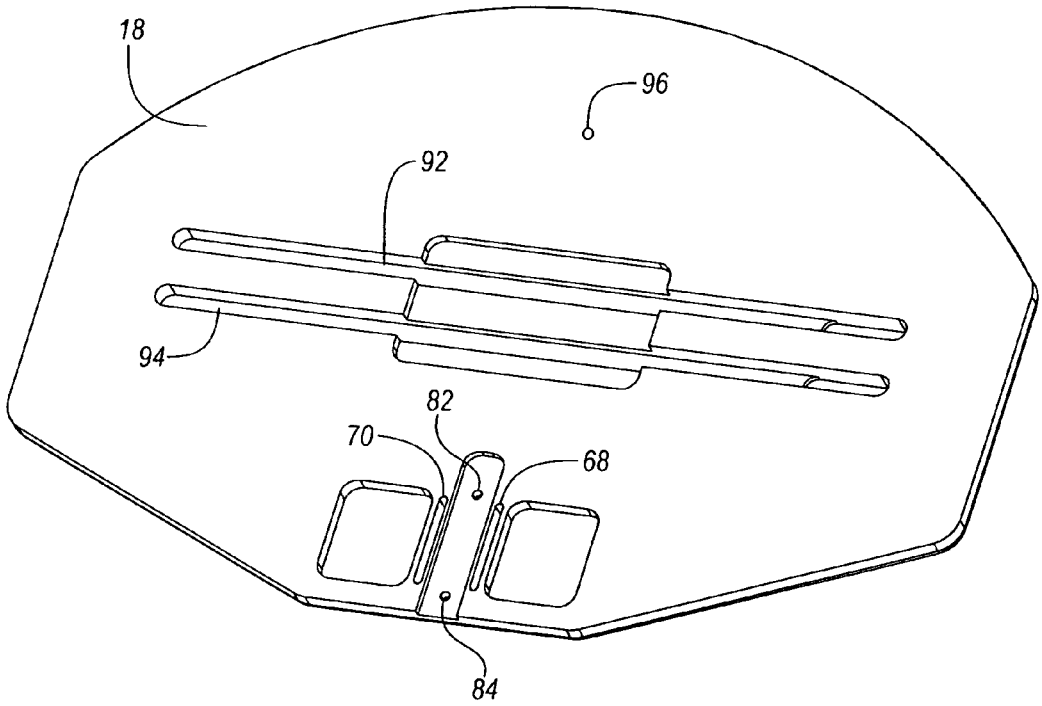
FIG. 15 is a perspective view of the backboard shown in FIG. 7.

As shown in FIGS. 8, 9 and 12, one or more of the components of the basketball goal system 10 may be arranged in an exemplary arrangement that facilitates efficient storage and/or shipping of the basketball goal system. For example, the support members 22, 24, 26 of the support structure 12 may be telescopically collapsed, and the support structure 12 may contact, abut and/or engage a portion of the base 16, such as an upper portion of the base, when the basketball goal system 10 is in the collapsed position.

When the basketball goal system 10 is in the collapsed position, at least a portion of one or more components (such as the rim assembly, braces, support structure, connecting member, etc.) may be positioned between the backboard 18 and the base 16. Advantageously, when the backboard 18 is connected to the base 16, that may help retain the components in the desired positions. In addition, the base 16 and/or the backboard 18 may include one or more receiving portions that are sized and configured to receive and/or retain at least a portion of the components between the base and the backboard when the base and backboard are connected. The receiving portions may retain the components using a snap fit, a friction fit, interference fit and the like. The component could also be retained within a receiving portion using fasteners or other suitable devices or means.

In further detail, as best seen in FIGS. 10-15, the base 16 may include a receiving portion 86 that is sized and configured to receive and/or retain at least a portion of the rim assembly 52, such as the rim 20 and/or the connecting member 52. The base 16 may also include receiving portions 88, 90 that are sized and configured to receive and/or retain at least a portion of the braces 28, 30, respectively. In addition, the backboard 18 may include receiving portions 92, 94 that are sized and configured to receive and/or retain at least a portion of the braces 28, 30. These various components of the basketball goal system 10 may also be attached to the base 16 and/or the backboard 18 using fasteners or outer suitable devices or means.

The backboard 18 may be attached to the base 16 using one or more fasteners. For example, the backboard 18 and the base 16 may include openings 82, 96, 98, 100 that are sized and configured to allow fasteners to connect the backboard to the base. The openings 82, 96 are preferably spaced apart from the outer perimeter of the backboard 18 and the openings 98, 100 are preferably spaced apart from the outer perimeter of the base, which may help the fasteners securely connect the backboard to the base. The openings 82, 96 and the openings 98, 100 also preferably extend through the backboard 18 and the base 16, respectively. It will be appreciated, however, that the openings 82, 96, 98, 100 may be formed in any suitable portions of the backboard 18 and the base 16, and the openings may have other appropriate sizes, shapes, configurations and arrangements. The backboard 18 may also be attached to the base 16 using other suitable devices or means.

Figure 16:
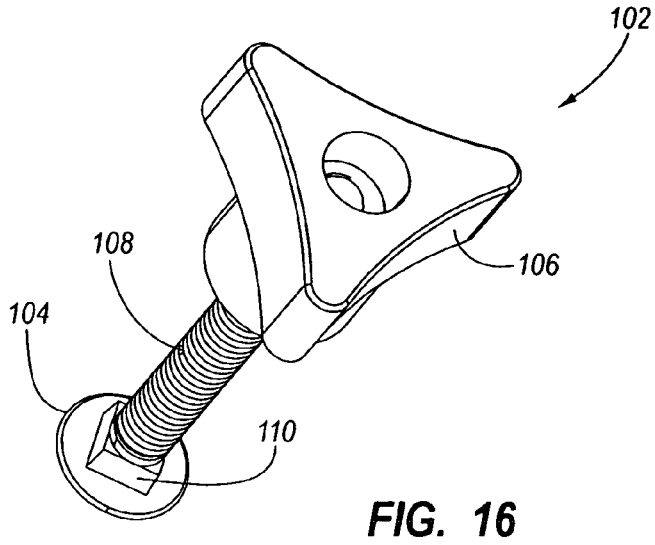
FIG. 16 is a perspective view of an exemplary fastener.
Figure 17:
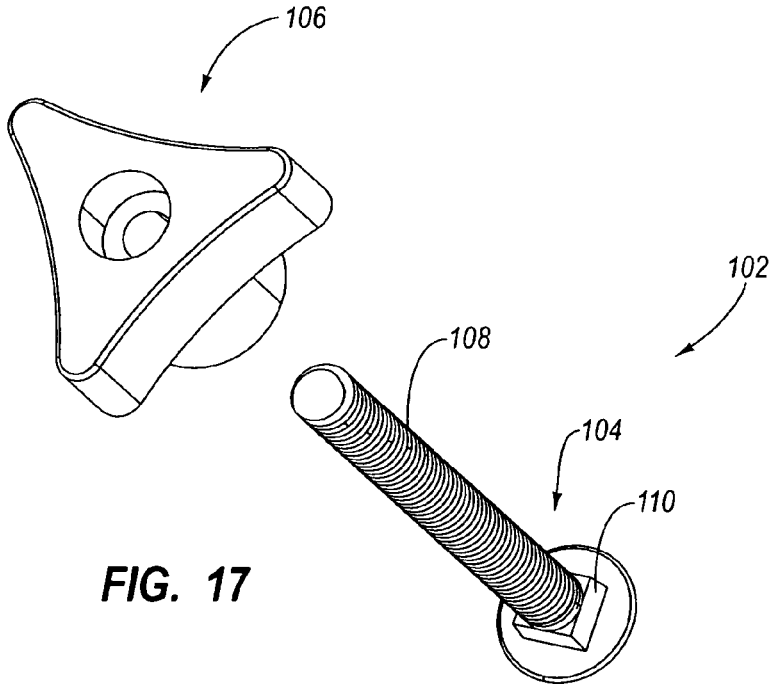
FIG. 17 is an exploded view of the fastener shown in FIG. 16.
Figure 18:
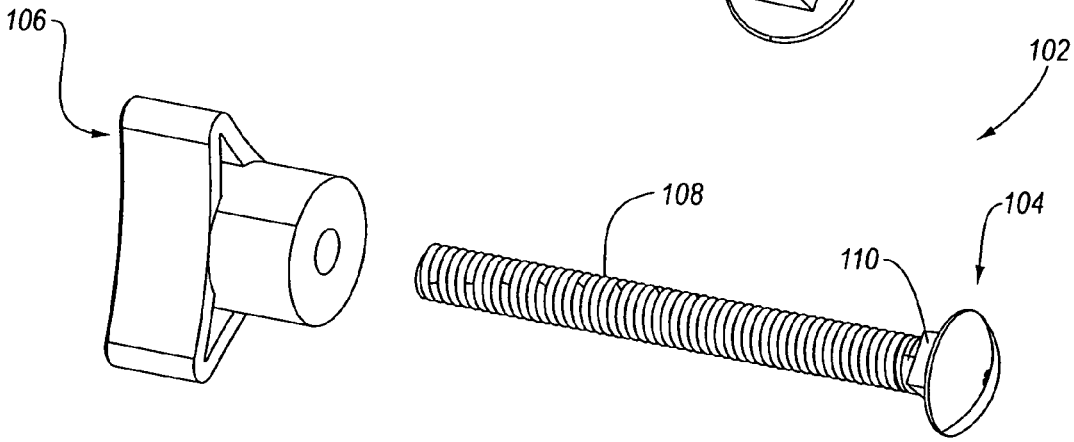
FIG. 18 is another exploded view of the fastener shown in FIG. 16.

As shown in FIGS. 16-18, an exemplary fastener 102 may include a first portion, such as a bolt 104, and a second portion, such as a handle 106, that are sized and configured to be selectively connected and disconnected. For example, the bolt 104 and the handle 106 may include complementary threaded portions 108 that allow the bolt and the handle to be connected. These fasteners 102 may be used to selectively connect and disconnect desired portions of the basketball goal system 10.

In greater detail, the fasteners 102 may be used to selectively connect and disconnect the backboard 18 and the base 16. For example, as shown in FIGS. 7-9 and 12, the bolt 104 of fastener 102*a* may be inserted through the opening 82 in the backboard 18 and the opening 98 in the base 16, and the bolt 104 of fastener 102*b* may be inserted through the opening 96 in the backboard and the opening 100 in the base. The handles 106 of the fasteners 102*a*, 102*b* may be coupled to the bolts 104 of the fasteners and the handles and/or the bolts may be rotated to connect the backboard 18 and the base 16. To disconnect the backboard 18 and the base 16, the handles 106 and/or the bolts 104 of the fasteners 102*a*, 102*b* may be rotated in an opposing direction.

The fasteners 102 may also be used to selectively connect and disconnect the support members 22, 24, 26. For example, as shown in FIG. 1, the bolt 104 of fastener 102*c* may be inserted through openings in the support members 22, 24 and the bolt 104 of fastener 102*d* may be inserted through openings in the support members 24, 26. The handles 106 of the fasteners 102*c*, 102*d* may be coupled to the bolts 104 of the fasteners, and the handles and/or the bolts may be rotated to connect the support members. To disconnect the support members, the handles 106 and/or the bolts 104 may be rotated in an opposing direction.

In addition, fasteners 102 may be used to selectively connect and disconnect the backboard 18 and the support structure 12. As shown in FIGS. 1, 2, 4 and 5, the bolt 104 of fastener 102*e* may be inserted through the opening 82 in the backboard 18 and at least one opening in the support member 22 of the support structure, and the bolt 104 of fastener 102*f* may be inserted through the opening 84 in the backboard 18 and at least one opening in the support member 22 of the support structure. The handles 106 of the fasteners 102*e*, 102*f* may be coupled to the bolts 104 of the fasteners, and the handles and/or the bolts may be rotated to connect the backboard 18 and the support structure 12. To disconnect the backboard 18 and the support structure 12, the handles 106 and/or the bolts 104 of the fasteners 102*e*, 102*f* may be rotated in an opposing direction.

Similarly, fasteners 102 may be used to selectively connect and disconnect the rim assembly 52 and the support structure 12. For example, the bolt 104 of a first fastener 102 may be inserted through the opening 72 in the flange 60, at least one opening in the support member 22 and the opening 76 in the flange 62; and the bolt 104 of a second fastener 102 may be inserted through the opening 74 in the flange 60, at least one opening in the support member 22 and the opening 78 in the flange 62. The handles 106 of the first and second fasteners 102 may be coupled to the bolts 104 of the fasteners and the handles and/or the bolts may be rotated in a first direction to connect the rim assembly 52 and the support structure 12. To disconnect the rim assembly 52 and the support structure 12, the handles 106 and/or the bolts 104 of the first and second fasteners 102 may be rotated in an opposing second direction.

Further, fasteners 102 may be used to selectively connect and disconnect the bracket 32 and the base 16. For instance, the bolt 104 of a first fastener 102 may be inserted through the opening 48 in the bracket 32 and the opening 50 in the base 16. The handle 106 of the first fastener 102 may be coupled to the bolt 104 of the first fastener and the handle and/or the bolt may be rotated to connect the bracket 32 and the base 16. To disconnect the bracket 32 and the base 16, the handle 106 and/or the bolt 104 of the first fastener 102 may be rotated in an opposing direction.

As shown in FIGS. 16, 17 and 18, the bolt 104 of the fastener 102 may include an engagement member 110 that is sized and configured to engage at least a portion of an opening (such as the opening 48 of the bracket 32 shown in FIG. 3; the openings 72, 74 of the flange 60 shown in FIG. 5; the openings 82, 84, 96 of the backboard 18 shown in FIG. 7; etc.). The engagement member 110 is preferably sized and configured to engage at least a portion of the opening to prevent or limit the rotational movement of the bolt 104 relative to the opening. Because the engagement member 110 may prevent or limit the rotational movement of the bolt 104 relative to the opening, the handle 106 may be more easily rotated relative to the bolt, which may allow the fastener 102 to connect, disconnect, tighten and/or loosen the connection between various components of the basketball goal system 10.

In greater detail, the engagement member 110 may have a non-circular shape, such as square, rectangular, polygonal, triangular, oblong, etc., which may help prevent or limit rotational movement of the fastener 102 relative to the opening. For example, at least a portion of the opening may have a non-circular configuration and the non-circular engagement member 110 may engage the non-circular portion of the opening. It will be appreciated, however, that the engagement member 110 may have a variety of other suitable shapes and configurations, if desired.

The basketball goal system 10 may also include one or more wheels to allow the basketball goal system to be readily moved from one location to another location. Advantageously, the wheels may be simply and easily connected to the basketball goal system 10. For example, the wheels may be connected to the support structure 12 and/or the base 16. In particular, the wheels may be connected to an axle that is connected to the support structure 12 and/or the base 16. The wheels, however, could be connected to other portions of the basketball goal system 10 in any suitable manner and the basketball goal system does not require wheels.

The base 16 may include a hollow interior portion that may receive ballast, such as water, sand, gravel, cement or the like. The base 16 may also include a relatively large surface or outer portion upon which one or more weights may be placed. In addition, the base 16 may be constructed from relatively lightweight materials, such as plastic, which may allow the basketball goal system 10 to be more easily shipped and transported. In particular, the base 16 could be constructed from blow-molded plastic to create a lightweight, rigid and sturdy structure. It will be appreciated that the base 16 could be constructed from other materials and processes with suitable characteristics and features.

While the base 16 is preferably constructed from plastic, other components of the basketball goal system 10 may be constructed from similar or different materials. For example, the backboard 18 may also be constructed from plastic that is blow-molded into the desired shape and configuration. The backboard 18 may also be constructed from other materials and processes. The support structure 12; support members 22, 24, 26; braces 28, 30; bracket 32; rim assembly 52; rim 20; rim braces 54, 56; and connecting member 58 are preferably constructed from a relatively strong and sturdy material, such as metal. Advantageously, these materials may allow a basketball goal system 10 to be constructed that is relatively strong, lightweight and long-lasting. It will be appreciated, however, that these and other components of the basketball goal system 10 may be constructed from other materials and processes with suitable characteristics.

In addition, various components of the basketball goal system 10 may be integrally formed as part of unitary, one-piece structure during, for example, the manufacturing process. For example, the base 16 and/or the backboard 18 may be integrally formed as part of unitary, one-piece structure during the blow molding process. These components may include a hollow interior portion formed during the blow molding process. Also, for example, the receiving portions 46, 68, 70, 86, 88, 90, 92, 94 and/or the openings 50, 82, 84, 96, 98, 100 may be integrally formed as part of unitary, one-piece structure during the blow-molding process. Integrally forming these items as part of unitary, one-piece structure may advantageously help reduce manufacturing time and costs. It will be appreciated that the base 16, the backboard 18 and other components or features of the basketball goal system 10 need not be integrally formed as part of any unitary, one-piece structure. It will also be appreciated that, as discussed above, the various components of the basketball goal system 10 may be made of any suitable materials and various appropriate processes depending, for example, upon the intended use of the basketball goal system.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball goal system that is capable of being moved between a playing position in which the basketball goal system may be used for playing basketball and a collapsed position in which the basketball goal system may be more easily transported or stored, the basketball goal system comprising:

a backboard including a first opening that is spaced apart from an outer perimeter of the backboard;

a support structure that is sized and configured to support the backboard above a playing surface when the basketball goal system is in the playing position;

a base that is sized and configured to support the support structure and the backboard when the basketball goal system is in the playing position, the base including a first opening that is spaced apart from an outer perimeter of the base;

a support brace including a first end connected to the base and a second end connected to the support structure when the basketball goal system is in the playing position; and a first fastener inserted into an opening in the first end of the support brace and the first opening in the base to connect the support brace to the base when the basketball goal system is in the playing position, the first fastener being inserted into the first opening in the backboard and the first opening in the base to connect the backboard and the base when the basketball goal system is in the collapsed position and further comprising a rim receiving portion disposed in a lower portion of the base that is sized and configured to receive a rim when the basketball goal system is in the collapsed position; and further comprising a support brace receiving portion in the lower portion of the base that receives a portion of the support brace when the basketball goal system is in the collapsed position; and further comprising a backboard receiving portion in the lower portion of the base that receives at least a portion of the backboard when the basketball goal system is in the collapsed position, the rim and the support brace being disposed between the lower portion of the base and the backboard when the basketball goal system is in the collapsed position; and further comprising a support structure receiving recess in an upper portion of the base that receives a portion of the support structure when the basketball goal system is in the collapsed position.

2. The basketball goal system as in claim 1, further comprising a support structure receiving recess on a first side of the base that receives and retains at least a portion of the support structure when the basketball goal system is in the collapsed position;

further comprising a rim assembly receiving recess on a second side of the base that receives at least a portion of a rim assembly when the basketball goal system is in the collapsed position;

further comprising a support brace receiving recess on the second side of the base that receives a portion of the support brace when the basketball goal system is in the collapsed position; and further comprising a backboard receiving recess on the second side of the base that receives at least a portion of the backboard when the basketball goal system is in the collapsed position.

3. The basketball goal system as in claim 1, further comprising a second opening in the base that is spaced apart from the outer perimeter of the base;

further comprising a second opening in the backboard that is spaced apart from the outer perimeter of the backboard; and further comprising a second fastener that is sized and configured to be inserted into the second opening in the backboard and the second opening in the base to connect the backboard and the base when the basketball goal system is in the collapsed position.

4. The basketball goal system as in claim 1, wherein the base is constructed from blow-molded plastic and includes an upper portion, a lower portion and a hollow interior portion that is disposed between the upper portion and the lower portion, the upper portion, the lower portion and the hollow interior portion being integrally formed during the blow-molding process as part of a unitary, one-piece structure;

wherein the first opening in the base extends through the upper portion and the lower portion of the base; and wherein the first opening in the base is integrally formed during the blow-molding process as part of the unitary, one-piece structure.

5. The basketball goal system as in claim 1, wherein the backboard is constructed from blow-molded plastic and includes a front portion, a rear portion and a hollow interior portion that is disposed between the front portion and the rear portion of the backboard, the front portion, the rear portion and the hollow interior portion being integrally formed during the blow-molding process as part of a unitary, one-piece structure;

wherein the first opening in the backboard extends through the front portion and the rear portion of the backboard; and wherein the first opening in the backboard is integrally formed during the blow-molding process as part of the unitary, one-piece structure.

6. The basketball goal system as in claim 1, wherein the support structure comprises at least three telescopically coupled support members that are movable between an extended position and a collapsed position, the collapsed position of the telescopically coupled support members have a length that is generally equal to or less than a length of the base to facilitate positioning the basketball goal system in the collapsed position.

7. The basketball goal system as in claim 6, further comprising a bracket receiving portion in an upper portion of the base;

further comprising a support structure receiving portion in the upper portion of the base; and further comprising a bracket disposed in the bracket receiving portion in the base, the bracket pivotally connecting the support structure to the base, the bracket being sized and configured to allow the support structure to be disposed in a generally upright configuration when the support members are in the extended position, the bracket being sized and configured to allow the support structure to be disposed in the support structure receiving portion in the base when the support members are in the collapsed position.

8. The basketball goal system as in claim 1, further comprising a rim assembly receiving portion in the lower portion of the base that receives at least a portion of a rim assembly when the basketball goal is in the collapsed position;

further comprising a support brace receiving portion disposed in the lower portion of the base that is sized and configured to receive at least a portion of the support brace when the basketball goal is in the collapsed position;

further comprising a backboard receiving portion in the lower portion of the base that receives at least a portion of the backboard when the basketball goal system is in the collapsed position, the rim and the support brace being disposed between the lower portion of the base and the backboard when the basketball goal system is in the collapsed position;

wherein the support brace is disposed between the backboard and the base when the basketball goal system is in the collapsed position.

9. The basketball goal system as in claim 1, further comprising a support brace receiving portion in the base that receives a portion of the support brace when the basketball goal is in the collapsed position; and further comprising a support brace receiving portion in a rear portion of the backboard that receives a portion of the support brace when the basketball goal is in the collapsed position, the support brace being disposed between the backboard and the base when the basketball goal system is in the collapsed position.

10. The basketball goal system as in claim 1, further comprising a receiving portion integrally formed in the base during the manufacturing process as part of a unitary, one-piece structure, the base receiving portion being sized and configured to receive at least a portion of a component of the basketball goal system when the basketball goal system is in the collapsed position; and a receiving portion integrally formed in backboard during the manufacturing process as part of a unitary, one-piece structure, the backboard receiving portion being sized and configured to receive at least a portion of the component of the basketball system when the basketball goal system is in the collapsed position, the component being disposed between the base and the backboard when the basketball goal system is in the collapsed position.

11. The basketball goal system as in claim 10, wherein the support brace is at least partially disposed within the base receiving portion and being at least partially disposed within the backboard receiving portion when the basketball goal system is in the collapsed position.

12. A portable basketball system that is capable of being moved between a playing position in which the basketball system may be used for playing basketball and a collapsed position in which the basketball system may be more easily transported or stored, the portable basketball system comprising:

a basketball goal including a backboard and a rim;

a support structure that is sized and configured to support the basketball goal above a playing surface when the basketball system is in the playing position;

a base that is sized and configured to support the support structure and the backboard when the basketball system is in the playing position, the base including an upper portion, lower portion and a hollow interior portion that are integrally formed as part of a unitary, one-piece structure;

a support structure receiving recess integrally formed in the upper portion of the base that receives the support structure when the basketball system is in the collapsed position;

a rim receiving portion integrally formed in the lower portion of the base as part of the unitary, one-piece structure, the rim receiving portion being sized and configured to receive the rim when the basketball system is in the collapsed position;

a backboard receiving recess integrally formed in the lower portion of the base that receives the backboard when the basketball system is in the collapsed position, the rim being disposed between the base and the backboard when the basketball system is in the collapsed position; and a first fastener that is sized and configured to connect the backboard and the base when the basketball system is in the collapsed position and further comprising a support brace including a first end that is connected to the base and a second end that is connected to the support structure when the basketball goal is in the playing position; and further comprising a support brace receiving portion disposed in a rear portion of the backboard that is sized and configured to receive at least a portion of the support brace when the basketball goal is in the collapsed position, the support brace being disposed between the backboard and the base when the basketball system is in the collapsed position.

13. The portable basketball system as in claim 12, further comprising a first opening in the backboard that is spaced apart from an outer perimeter of the backboard; and further comprising a first opening in the base that extends through the upper portion and the lower portion of the base, the first opening being integrally formed with the base as part of the unitary, one-piece structure, the first opening being spaced apart from an outer perimeter of the base, the first fastener extending through the first opening in the backboard and the first opening in the base to connect the backboard to the base when the basketball goal is in the collapsed position.

14. The portable basketball system as in claim 13, further comprising a second opening in the backboard that is spaced apart from the outer perimeter of the backboard;

further comprising a second opening in the base that extends through the upper portion and the lower portion of the base, the second opening being integrally formed with the base as part of the unitary, one-piece structure, the second opening being spaced apart from the outer perimeter of the base; and further comprising a second fastener that is sized and configured to be inserted into the second opening in the backboard and the second opening in the base to connect the backboard and the base when the basketball system is in the collapsed position.

15. The portable basketball system as in claim 12, wherein the support structure comprises at least three telescopically coupled support members that are movable between an extended position and a collapsed position, the collapsed position of the telescopically coupled support members have a length that is generally equal to or less than a length of the base to facilitate positioning the basketball system in the collapsed position.

16. The portable basketball system as in claim 12, further comprising a bracket receiving portion integrally formed in an upper portion of the base as part of the unitary, one-piece structure;

further comprising a support structure receiving portion integrally formed in the upper portion of the base;

further comprising a bracket disposed in the bracket receiving portion in the base and connecting the support structure and the base, the bracket being sized and configured to allow the support structure to be disposed in a generally upright configuration when the support members are in the extended position, the bracket being sized and configured to allow the support structure to be disposed in the support structure receiving portion in the upper portion of the base when the support members are in the collapsed position; and further comprising a support brace receiving portion integrally formed in the lower portion of the base that receives a support brace when the basketball system is in the collapsed position, the support brace being disposed between the base and the backboard when the basketball system is in the collapsed position.

17. The portable basketball system as in claim 12, wherein the rim receiving portion is sized and configured to receive the rim and a connecting structure that connects the rim to the support structure when the basketball system is in the collapsed position.

18. The portable basketball system as in claim 12, further comprising a support brace including a first end that is connected to the base and a second end that is connected to the support structure when the basketball goal is in the playing position; and further comprising a support brace receiving portion disposed in the lower portion of the base that is sized and configured to receive a portion of the support brace when the basketball goal is in the collapsed position; and further comprising a support brace receiving portion disposed in a rear portion of the backboard that is sized and configured to receive a portion of the support brace when the basketball goal is in the collapsed position, the support brace being disposed between the backboard and the base when the basketball system is in the collapsed position.

19. The portable basketball system as in claim 12, further comprising a receiving portion integrally formed in the base during the manufacturing process as part of a unitary, one-piece structure, the base receiving portion being sized and configured to receive at least a portion of a component of the basketball system when the basketball system is in the collapsed position; and a receiving portion integrally formed in backboard during the manufacturing process as part of a unitary, one-piece structure, the backboard receiving portion being sized and configured to receive at least a portion of the component of the basketball system when the basketball system is in the collapsed position, the component being disposed between the base and the backboard when the basketball system is in the collapsed position.

20. The portable basketball system as in claim 19, further comprising a brace including a first end that is connected to the support structure and a second end that is connected to the base when the basketball system is in the playing position, the brace being at least partially disposed within the base receiving portion and being at least partially disposed within the backboard receiving portion when the basketball system is in the collapsed position.

21. The portable basketball system as in claim 12, further comprising a connecting structure that is sized and configured to connect the rim to the support structure when the basketball goal is in the playing position, the connecting structure including at least one flange that extends through an opening in the backboard.

22. The portable basketball system as in claim 12, wherein the fastener that is sized and configured to connect the backboard and the base when the basketball system is in the collapsed position is also sized and configured to connect the rim and the support structure when the basketball system is in the playing position.

23. The portable basketball system as in claim 12, wherein fastener that is sized and configured to connect the backboard and the base when the basketball system is in the collapsed position is also sized and configured to connect a support brace to the support structure or the base when the basketball system is in the playing position.

24. The portable basketball system as in claim 12, wherein the fastener that is sized and configured to connect the backboard and the base when the basketball system is in the collapsed position is also sized and configured to connect the backboard and the support structure when the basketball system is in the playing position.

25. A portable basketball system that is capable of being moved between a playing position in which the basketball system may be used for playing basketball and a collapsed position in which the basketball system may be more easily transported or stored, the portable basketball system comprising:

a basketball goal including a backboard and a rim assembly;

a support structure that is sized and configured to support the basketball goal above a playing surface when the basketball system is in the playing position;

a base that is sized and configured to support the support structure and the backboard when the basketball system is in the playing position, the base including an upper portion, lower portion and a hollow interior portion that are integrally formed as part of a unitary, one-piece structure;

a support structure receiving portion integrally formed in the upper portion of the base that receives the support structure when the basketball system is in the collapsed position;

a rim assembly receiving portion integrally formed in the lower portion of the base as part of the unitary, one-piece structure, the rim assembly receiving portion being sized and configured to receive the rim assembly when the basketball system is in the collapsed position, the rim assembly being disposed between the base and the backboard when the basketball system is in the collapsed position;

a support brace including a first end that is connected to the base and a second end that is connected to the support structure when the basketball goal is in the playing position; and a support brace receiving portion integrally formed in the lower portion of the base as part of the unitary, one-piece structure, the support brace receiving portion being sized and configured to receive a portion of the support brace when the basketball goal is in the collapsed position, the support brace being disposed between the backboard and the base when the basketball system is in the collapsed position and further comprising a support brace receiving portion disposed in a rear portion of the backboard that is sized and configured to receive a portion of the support brace when the basketball goal is in the collapsed position.

26. The portable basketball system as in claim 25, further comprising a fastener that is sized and configured to connect the backboard and the base when the basketball system is in the collapsed position, the fastener extending through an opening extending through the upper portion and the lower portion of the base, the opening being integrally formed with the base as part of the unitary, one-piece structure, the opening being spaced apart from an outer perimeter of the base.

27. The portable basketball system as in claim 25, wherein a fastener connects the basketball goal to the support structure when the basketball system is in the playing position and the same fastener connects the backboard to the base when the basketball system is in the collapsed position.

* * * * *